US006375886B1

(12) United States Patent
Angadjivand et al.

(10) Patent No.: US 6,375,886 B1
(45) Date of Patent: Apr. 23, 2002

(54) METHOD AND APPARATUS FOR MAKING A NONWOVEN FIBROUS ELECTRET WEB FROM FREE-FIBER AND POLAR LIQUID

(75) Inventors: Seyed A. Angadjivand, Woodbury; Michael G. Schwartz, Hugo; Philip D. Eitzman, Lake Elmo; Marvin E. Jones, Grant, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/415,566

(22) Filed: Oct. 8, 1999

(51) Int. Cl.[7] ..... H05B 7/16; B27N 3/04

(52) U.S. Cl. ..... 264/460; 264/6; 264/115; 264/122

(58) Field of Search ..... 264/6, 115, 122, 264/460

(56) References Cited

U.S. PATENT DOCUMENTS

| | | | |
|---|---|---|---|
| 3,366,721 | A | 1/1968 | Burdge et al. |
| 3,959,421 | A | 5/1976 | Weber et al. |
| 4,118,531 | A | 10/1978 | Hauser |
| 4,204,828 | A | 5/1980 | Peckinpaugh et al. |
| 4,215,682 | A | 8/1980 | Kubik et al. |
| 4,277,430 | A | 7/1981 | Peckinpaugh et al. |
| 4,288,584 | A | 9/1981 | Mishra |
| RE30,782 | E | 10/1981 | van Turnhout |
| 4,340,563 | A | 7/1982 | Appel et al. |
| RE31,285 | E | 6/1983 | van Turnhout et al. |
| 4,548,628 | A | 10/1985 | Miyake et al. |

(List continued on next page.)

FOREIGN PATENT DOCUMENTS

| | | |
|---|---|---|
| EP | 0 845 554 A2 | 6/1998 |
| GB | 711344 | 6/1954 |
| JP | 60-947 | 1/1985 |
| JP | 60-15137 | 4/1985 |
| WO | WO 95/22646 | 8/1995 |
| WO | WO 96/00093 | 1/1996 |

OTHER PUBLICATIONS

Japan Technology Highlights, Removal of Static Electricity with Water Spray, v.6, n. 23, pp. 5–6 (Nov. 15, 1995).

Chudleigh, P.W., Charging of Polymer Foils Using Liquid Contacts, Appl. Phys. Lett., v. 21, n. 11 (Dec. 1, 1972).

Chudleigh, P.W., Mechanism of Charge Transfer to a Polymer Surface by a Conducting Liquid Contact, *Journal of Applied Physics*, v. 47, n. 10 (Oct. 1976).

Qin, G–W. et al., The Effect of Water–quenching on the Electrostatic Charging of Fibers and Fabrics During the Melt–blowing Process, *J. Text Inst. 1999*, 90 Part 1, No. 2.

Strobel, M. et al., Plasma Fluorination of Polyolefins, *Journal of Polymer Science: Part A: Polymer Chemistry*, v. 25, 1295–1307 (1987).

Wente, Van A., Superfine Thermoplastic Fibers, *Industrial and Engineering Chemistry*, v. 48, n. 8, pp.–1342–1346 (Aug. 1956).

Yatsuzuka, K. et al., Electrification of Polymer Surface Caused by Sliding Ultrapure Water, *IEEE Transactions on Industry Applications*, v. 32, n. 4 (Jul./Aug. 1996).

*Primary Examiner*—Mary Lynn Theisen
(74) *Attorney, Agent, or Firm*—Karl G. Hanson

(57) ABSTRACT

A method and apparatus for charging fibers that contain a nonconductive polymer. A polar liquid 32, 34 is sprayed onto free-fibers 24, and the free-fibers 24 are then collected to form an entangled nonwoven fibrous web 25 that may contain a portion of the polar liquid. The nonwoven web 25 is then dried 38. By applying an effective amount of polar liquid 32, 34 onto the nonconductive free-fibers 24 before forming the nonwoven web 25, followed by drying 38, the individual fibers 24 become charged. The method and apparatus enable the fibers 24 to be charged during web manufacture without subsequent processing.

46 Claims, 1 Drawing Sheet

U.S. PATENT DOCUMENTS

| | | | | |
|---|---|---|---|---|
| 4,588,537 | A | | 5/1986 | Klaase et al. |
| RE32,171 | E | | 6/1986 | van Turnhout |
| 4,592,815 | A | | 6/1986 | Nakao |
| 4,594,202 | A | | 6/1986 | Pall et al. |
| 4,652,282 | A | | 3/1987 | Ohmori et al. |
| 4,789,504 | A | | 12/1988 | Ohmori et al. |
| 4,798,850 | A | | 1/1989 | Brown |
| 4,874,399 | A | | 10/1989 | Reed et al. |
| 4,874,659 | A | | 10/1989 | Ando et al. |
| 4,931,230 | A | | 6/1990 | Krueger et al. |
| 4,950,549 | A | | 8/1990 | Rolando et al. |
| 5,057,710 | A | | 10/1991 | Nishiura et al. |
| 5,078,925 | A | | 1/1992 | Rolando et al. |
| 5,254,297 | A | | 10/1993 | Deeds ..... 425/174.8 E |
| 5,254,378 | A | | 10/1993 | Krueger et al. |
| 5,280,406 | A | | 1/1994 | Coufal et al. |
| 5,370,830 | A | | 12/1994 | Jameson et al. |
| 5,401,446 | A | | 3/1995 | Tsai et al. |
| 5,411,576 | A | | 5/1995 | Jones et al. |
| 5,472,481 | A | | 12/1995 | Jones et al. |
| 5,496,507 | A | * | 3/1996 | Angadjivand et al. ..... 264/12 |
| 5,525,397 | A | | 6/1996 | Shizuno et al. ..... 428/138 |
| 5,592,357 | A | | 1/1997 | Rader et al. |
| 5,665,278 | A | | 9/1997 | Allen et al. |
| 5,780,153 | A | | 7/1998 | Chou et al. |
| 5,908,598 | A | | 6/1999 | Rousseau et al. |
| 5,919,847 | A | | 7/1999 | Rousseau et al. |
| 5,968,635 | A | | 10/1999 | Rousseau et al. |
| 5,976,208 | A | | 11/1999 | Rousseau et al. |

* cited by examiner

METHOD AND APPARATUS FOR MAKING A NONWOVEN FIBROUS ELECTRET WEB FROM FREE-FIBER AND POLAR LIQUID

The present invention pertains to a method that uses a polar liquid to charge nonconductive free-fibers to form an electrically-charged nonwoven fibrous web. The present invention also pertains to an apparatus that is suitable for making such a web.

BACKGROUND

Electrically-charged nonwoven webs are commonly used as filters in respirators to protect the wearer from inhaling airborne contaminants. U.S. Pat. Nos. 4,536,440, 4,807,619, 5,307,796, and 5,804,295 disclose examples of respirators that use these filters. The electric charge enhances the ability of the nonwoven web to capture particles that are suspended in a fluid. The nonwoven web captures the particles as the fluid passes through the web. The nonwoven web typically contains fibers that comprise dielectric—that is, nonconductive—polymers. Electrically-charged dielectric articles are often referred to as "electrets", and a variety of techniques have been developed over the years for producing these products.

Early work relating to electrically-charging polymer foils is described by P. W. Chudleigh in Mechanism of Charge Transfer to a Polymer Surface by a Conducting Liquid Contact, 21 APPL. PHYS. LETT., 547–48 (Dec. 1, 1972), and in Charging of Polymer Foils Using Liquid Contacts, 47 J. APPL. PHYS., 4475–83 (October 1976). Chudleigh's method involves charging a polyfluoroethylene polymer foil by applying a voltage to the foil. The voltage is applied through use of a conducting liquid that contacts the foil surface.

An early-known technique for making a polymeric electret in fibrous form is disclosed in U.S. Pat. No. 4,215,682 to Kubic and Davis. In this method, the fibers are bombarded with electrically-charged particles as they issue from a die orifice. The fibers are created using a "melt-blowing" process, Where a stream of gas, which is blown at high velocity next to the die orifice, draws out the extruded polymeric material and cools it into a solidified fiber. The bombarded melt-blow fibers accumulate randomly on a collector to create the fibrous electret web. The patent mentions that filtering efficiency can be improved by a factor of two or more when the melt-blown fibers are electrically-charged in this fashion.

Fibrous electret webs also have been produced by charging them with a corona. U.S. Pat. No. 4,588,537 to Klaase et al., for example, shows a fibrous web that is continuously fed into a corona discharge device while positioned adjacent to one major surface of a substantially-closed dielectric foil. The corona is produced from a high-voltage source that is connected to oppositely-charged thin tungsten wires. Another high-voltage technique for imparting an electrostatic charge to a nonwoven web is described in U.S. Pat. No. 4,592,815 to Nakao. In this charging process, the web is brought into tight contact with a smooth-surfaced ground electrode.

Fibrous electret webs also may be produced from polymer films or foils, as described in U.S. Pat. Nos. Re. 30,782, Re. 31,285, and Re. 32,171 to van Turnhout. The polymer films or foils are electrostatically charged before being fibrillated into fibers that are subsequently collected and processed into a nonwoven fibrous filter.

Mechanical approaches also have been used to impart an electric charge to fibers. U.S. Pat. No. 4,798,850 to Brown describes a filter material that contains a mixture of two different crimped synthetic polymer fibers that have been carded into a fleece and then needled to form a felt. The patent describes mixing the fibers well so that they become electrically-charged during the carding. The process disclosed in Brown is commonly referred to as "tribocharging".

Tribocharging also can occur when high-velocity uncharged jets of gases or liquids are passed over the surface of a dielectric film. In U.S. Pat. No. 5,280,406, Coufal et al. disclose that when jets of an uncharged fluid strike the surface of the dielectric film, the surface becomes charged.

A more recent development uses water to impart electric charge to a nonwoven fibrous web (see U.S. Pat. No. 5,496,507 to Angadjivand et al.). The electric charge is created by impinging pressurized jets of water or a stream of water droplets onto a nonwoven web that contains nonconductive microfibers. The resulting charge provides filtration-enhancing properties. Subjecting the web to an air corona discharge treatment before the hydrocharging operation can further enhance electret performance.

Adding certain additives to the web has improved the performance of electrets. An oily-mist resistant electret filter media, for example, has been provided by including a fluorochemical additive in melt-blown polypropylene microfibers; see U.S. Pat. Nos. 5,411,576 and 5,472,481 to Jones et al. The fluorochemical additive has a melting point of at least 25° C. and a molecular weight of about 500 to 2500.

U.S. Pat. No. 5,908,598 to Rousseau et al. describes a method where an additive is blended with a thermoplastic resin to form a fibrous web. Jets of water or a stream of water droplets are impinged onto the web at a pressure sufficient to provide the web with filtration-enhancing electret charge. The web is subsequently dried. The additives may be (i) a thermally stable organic compound or oligomer, which compound or oligomer contains at least one perfluorinated moiety, (ii) a thermally stable organic triazine compound or oligomer which contains at least one nitrogen atom in addition to those in the triazine group, or (iii) a combination of (i) and (ii).

Other electrets that contain additives are described in U.S. Pat. No. 5,057,710 to Nishiura. The polypropylene electrets disclosed in Nishiura contain at least one stabilizer selected from hindered amines, nitrogen-containing hindered phenols, and metal-containing hindered phenols. The patent discloses that an electret that contains these additives can offer high heat-stability. The electret treatment was carried out by placing the nonwoven fabric sheet between a needle-like electrode and an earth electrode. U.S. Pat. Nos. 4,652,282 and 4,789,504 to Ohmori et al. describe incorporating a fatty acid metal salt in an insulating polymer to maintain high dust-removing performance over a long period of time. Japanese Patent Kokoku JP60-947 describes electrets that comprise poly 4-methyl-1-pentene and at least one compound selected from (a) a compound containing a phenol hydroxy group, (b) a higher aliphatic carboxylic acid and its metal salts, (c) a thiocarboxylate compound, (d) a phosphorous compound, and (e) an ester compound. The patent indicates that the electrets have long-term storage stability.

A recently-published U.S. patent discloses that filter webs can be produced without deliberately post-charging or electrizing the fibers or the fiber webs (see U.S. Pat. No. 5,780,153 to Chou et al.). The fibers are made from a copolymer that comprises: a copolymer of ethylene, 5 to 25 weight percent of (meth)acrylic acid, and optionally, though less preferably, up to 40 weight percent of an alkyl (meth)

acrylate whose alkyl groups have from 1 to 8 carbon atoms. Five to 70% of the acid groups are neutralized with a metal ion, particularly zinc, sodium, lithium or magnesium ions, or mixtures of these. The copolymer has a melt index of 5 to 1000 grams (g) per 10 minutes. The remainder may be a polyolefin such as polypropylene or polyethylene. The fibers may be produced through a melt-blowing process and may be cooled quickly with water to prevent excess bonding. The patent discloses that the fibers have high static retention of any existing or deliberate, specifically induced, static charge.

SUMMARY OF THE INVENTION

The present invention provides a new method and apparatus, which are both suitable for making nonwoven fibrous electret webs. The method of making a nonwoven fibrous electret web comprises the steps: (a) forming one or more free-fibers from a nonconductive polymeric fiber-forming material; (b) spraying an effective amount of polar liquid onto the free-fibers; (c) collecting the free-fibers to form a nonwoven fibrous web; and (d) drying the fibers, the nonwoven web, or both, to form a nonwoven fibrous electret web.

The inventive apparatus includes a fiber-forming device that is capable of forming one or more free-fibers. A spraying system is positioned to allow a polar liquid to be sprayed onto the free-fibers. And a collector is positioned to collect the free-fibers in the form of a nonwoven fibrous web; while a drying mechanism is positioned to actively dry the resulting fibers or the nonwoven fibrous web.

The method of the present invention is different from known methods in that it involves spraying an effective amount of a polar liquid onto nonconductive free-fibers. After drying the nonwoven web, an electret charge becomes imparted on the fibers to create a nonwoven fibrous electret. There are a number of patents that disclose contacting a free-fiber with a liquid. In the known techniques, the free-fibers are exposed to the liquid for the purpose of quenching the fibers. The quenching step is employed for a variety of reasons, including to provide a noncrystalline mesomorphous polymer, to provide higher throughputs, to cool the fibers to prevent excess bonding, and to increase yarn uniformity (see U.S. Pat. Nos. 3,366,721, 3,959,421, 4,277,430, 4,931,230, 4,950,549, 5,078,925, 5,254,378, and 5,780,153). Although these patents generally disclose quenching the fiber with a liquid shortly after the fiber is formed, the patents do not indicate that an electret can be produced from spraying a polar liquid onto a nonconductive free-fiber. Applicants discovered that you need (i) a polar liquid, (ii) a nonconductive polymeric fiber-forming material, (iii) an effective amount of polar liquid, and (iv) a drying step to produce a nonwoven fibrous electret article.

The inventive method is advantageous in that the electret production steps are basically integral with the fiber-forming process and thus can conceivably reduce the number of steps for making a nonwoven fibrous electret web. Although subsequent charging techniques certainly may be employed in connection with the invention, an electret may be produced without the need or requirement for a charging operation that goes substantially beyond the web production process.

The apparatus of the invention differs from known fiber-producing apparatuses in that it includes a drying mechanism positioned to actively dry the fibers or the resulting nonwoven web. Known apparatuses have not employed a dryer because the quenching liquid apparently was used only in amounts sufficient to cool or quench the fibers and would passively dry by evaporation.

Finished articles produced in accordance with the method and apparatus of the invention may contain a persistent electric charge when dried, for example, on the collector. They do not necessarily need to be subjected to a subsequent corona or other charging operation to create the electret. The resulting electrically-charged nonwoven webs may be useful as filters and may maintain a substantially homogenous charge distribution throughout web use. The filters may be particularly suitable for use in respirators.

As used in this document:

"free-fiber" means a fiber, or a polymeric fiber-forming material, in transit between a fiber-forming device and a collector.

"effective amount" means the polar liquid is used in quantities sufficient to enable an electret to be produced from spraying the free-fibers with the polar liquid followed by drying.

"electret" means an article that possesses at least quasi-permanent electric charge.

"electric charge" means that there is charge separation.

"fibrous" means possessing fibers and possibly other ingredients.

"nonwoven fibrous electret web" means a nonwoven web that comprises fibers and that exhibits at least a quasi-permanent electric charge.

"quasi-permanent" means that the electric charge resides in the web under standard atmospheric conditions (22° C., 101,300 Pascals atmospheric pressure, and 50% humidity) for a time period long enough to be significantly measurable.

"liquid" means the state of matter between a solid and a gas and includes a liquid in the form of a continuous mass, such as a stream, or in the form of a vapor or droplets such as a mist.

"microfiber" means fiber(s) that have an effective diameter of about 25 micrometers or less.

"nonconductive" means possessing a volume resistivity of about $10^{14}$ ohm.cm or greater at room temperature (22° C.).

"nonwoven" means a structure, or portion of a structure, in which the fibers are held together by a means other than weaving.

"polar liquid" means a liquid that has a dipole moment of at least about 0.5 Debye and a dielectric constant of at least about 10.

"polymer" means an organic material that contains repeating linked molecular units or groups, regularly or irregularly arranged and includes homopolymers, copolymers, and blends of polymers.

"polymeric fiber-forming material" means a composition that contains a polymer, or that contains monomers that are capable of producing a polymer, and possibly other ingredients, and that is capable of being formed into solid fibers.

"spraying" means allowing the polar liquid to come into contact with the free-fiber by any suitable method or mechanism.

"web" means a structure that is significantly larger in two dimensions than in a third and that is air permeable.

DETAILED DESCRIPTION OF PREFERRED EMBODIMENTS

Figure 1:
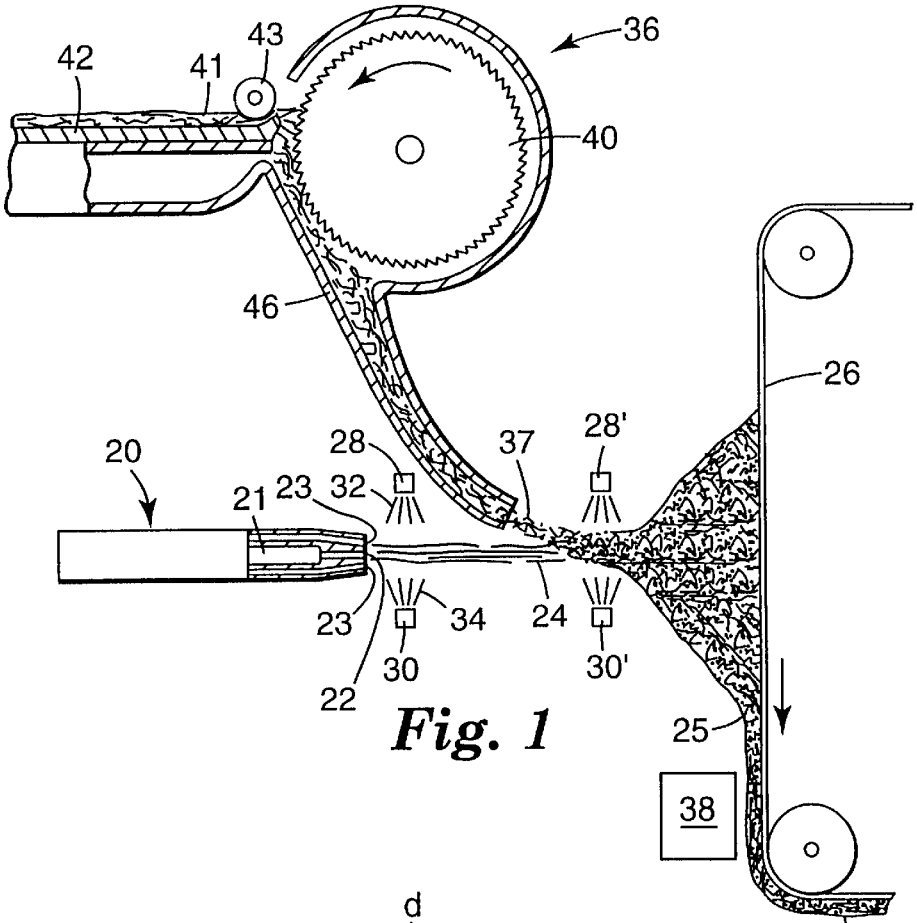
FIG. 1 is a partially-broken side view of an apparatus for charging free-fiber 24 in accordance with the present invention.

In the inventive method and apparatus, an electrostatic charge may be imparted to one or more fibers in a nonwoven web. In so doing, a polar liquid is sprayed onto free-fibers as they exit a fiber-forming device, such as an extrusion die. The fibers comprise a non-conductive polymeric material, and an effective amount of polar liquid is sprayed onto the fibers, preferably while they are not substantially entangled or assembled into a web. The wetted fibers are collected and dried in either order, but preferably are collected in wet form followed by drying. The resulting nonwoven web preferably has a high quantity of quasi-permanent trapped unpolarized charge.

In a preferred embodiment, the present invention consists essentially of: (a) forming one or more free-fibers from a nonconductive polymeric fiber-forming material; (b) spraying a polar liquid onto the free-fibers; (c) collecting the free-fibers to form a nonwoven fibrous web; and (d) drying the fibers and/or nonwoven web to form a nonwoven fibrous electret web. The term "consists essentially of" is used in this document as an open-ended term that excludes only those steps that would have a deleterious effect on the electric charge present on the electret web. For example, if the electret web was subsequently processed such that the additional processing step caused the electric charge to significantly dissipate from the nonwoven web, then that additional step would be excluded from the method that consists essentially of steps (a)–(d) recited above.

In another preferred embodiment, the method of the invention is composed of steps (a)–(d). The term "composed of" is also used in this application as an open-ended term, but it excludes only those steps that are wholly unrelated to electret production. Thus, when an invention is composed of steps (a)–(d) recited above, the inventive method would exclude steps that are carried out for reasons that have absolutely no bearing on producing a fibrous electret. Such steps might also have a deleterious effect, but if they are employed for reasons that in no way pertain to electret production, they would be excluded from a method that is composed of steps (a)–(d).

Nonwoven fibrous electret webs produced in accordance with the present invention exhibit a quasi-permanent electric charge. Preferably, the nonwoven fibrous electret webs exhibit a "persistent" electric charge, which means that the electric charge resides in the fibers and hence the nonwoven web for at least the commonly-accepted useful life of the product in which the electret is employed. The filtration efficiency of an electret can be generally estimated from an Initial Quality Factor, $QF_i$. An Initial Quality Factor, $QF_i$, is a Quality Factor that has been measured before the nonwoven fibrous electret web has been loaded—that is, before the electret has been exposed to an aerosol that is intended to be filtered. The Quality Factor can be ascertained as described below under the "DOP Penetration and Pressure Drop Test". The quality factor of the resulting nonwoven fibrous electret web preferably increases by at least a factor of 2 over an untreated web of essentially the same construction, and more preferably by a factor of at least 10. Preferred nonwoven fibrous electret webs produced according to the invention may possess sufficient electric charge to enable the product to exhibit a $QF_i$ of greater than 0.4 (millimeters (mm) $H_2O)^{-1}$, more preferably greater than 0.9 mm $H_2O^{-1}$, still more preferably greater than 1.3 mm $H_2O^{-1}$, and even more preferably greater than 1.7 or 2.0 mm $H_2O^{-1}$.

In one embodiment of the method of making an electret article, a stream of free-fibers is formed by extruding the fiber-forming material into a high-velocity gaseous stream. This operation is commonly referred to as a melt-blowing process. For many years, nonwoven fibrous filter webs have been made using a melt-blowing apparatus of the type described in Van A Wente, Superfine Thermoplastic Fibers, INDUS. ENGN. CBEM., vol. 48, pp. 1342–1346, and in Report No. 4364 of the Naval Research Laboratories, published May 25, 1954, entitled Manufacture of Super Fine Organic Fibers by Van A Wente et al. The gaseous stream typically breaks-off the end of the free-fiber. The length of the fiber, however, typically is indeterminate. The free-fibers become randomly entangled at, immediately in front of, or on the collector. The fibers typically become so entangled that the web is handleable by itself as a mat. It is sometimes difficult to ascertain where a fiber begins or ends, and thus the fibers appear to be essentially continuously disposed in the nonwoven web—although they may be broken off in the blowing process.

Alternatively, the free-fibers may be formed using a spun-bond process in which one or more continuous polymeric free-fibers are extruded onto a collector, see, for example, U.S. Pat. No. 4,340,563. Free-fibers might also be produced using an electrostatic spinning process as described for example in U.S. Pat. Nos. 4,043,331, 4,069,026, and 4,143,196, or by exposing a molten polymeric material to an electrostatic field—see, U.S. Pat. No. 4,230,650. During the step of spraying with the polar liquid, the free-fibers may be in a liquid or molten state, a mixture of liquid and solid states (semi-molten), or a solid state.

Figure 2:
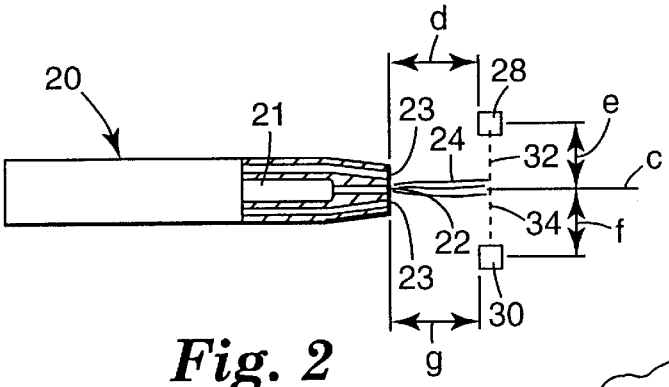
FIG. 2 is a partially-broken enlarged side view of the die 20 of FIG. 1.

FIGS. 1 and 2 illustrate one embodiment of producing an electret web that contains melt-blown fiber. Die 20 has an extrusion chamber 21 through which liquefied fiber-forming material is advanced until it exits the die through an orifice 22. Cooperating gas orifices 23—through which a gaseous stream, typically heated air, is forced at high velocity—are positioned proximate die orifice 22 to assist in drawing the fiber-forming material through the orifice 22. For most commercial applications, a multitude of die orifices 22 are arranged in-line across the forward end of the die 20. As the fiber-forming material is advanced, a multitude of fibers are emitted from the die face and collect as a web 25 on a collector 26. The orifice 22 is arranged to direct the free-fiber(s) 24 toward the collector 26. The fiber-forming material tends to solidify in the interval between the die 20 and the collector 26. U.S. Pat. No. 4,118,531 to Hauser and U.S. Pat. No. 4,215,682 to Kubik and Davis describe a melt-blowing apparatus that employs technology of this kind.

As the fiber-forming material is extruded from the die 20, he gaseous stream draws out one or more continuous free-fibers 24. As the length of the free-fiber 24 increases, the gaseous stream may attenuate or break-off the end of the free-fiber 24. The broken piece of free-fiber is carried in the gaseous stream to the collector 26. The process parameters for forming the free-fiber 24 may be varied to alter the fiber-breaking location. For example, reducing the cross-sectional fiber diameter, or increasing the gas stream velocity, generally causes the fiber to break closer to the die 20.

To maximize the electric charge in a nonwoven web, the fibers preferably are not substantially entangled during the spraying step. Spraying is most effective when performed before the free-fibers 24 become entangled. Entangled fibers overlap and may prevent some of the fibers from being exposed to the polar liquid spray and may thus reduce the resulting electric charge. In applications where multiple fibers 24 are formed simultaneously, the polar liquid spray could entangle the fibers and thereby prevent some of the fibers from being sprayed with the polar liquid. Additionally, the fibers 24 would likely be driven off-course by the force of the polar liquid spray, making it more difficult to collect the fibers.

The gaseous stream controls fiber movement during transit to the collector 26. As the fiber 24 leaves the orifice 22, the distal end of the fiber 24 is free to move and become entangled with adjacent fibers. The proximal end of the fiber 24, however, is continuously engaged with the orifice 22, minimizing entanglement immediately in front of the die 20. Consequently, spraying is preferably performed close to the die orifice 22.

When a high-velocity gaseous stream is not used, such as in a spun-bond process, a continuous free-fiber is typically deposited on the collector. After collection, the continuous free-fiber is entangled to form a web by a variety of processes known in the art, including embossing and hydroentanglement. Spraying a continuous spun-bond fiber stream near the collector promotes entanglement since the distal end of the fiber is more easily moved by the force of the polar liquid spray.

In FIG. 2, an upper spraying mechanism 28 is shown located above a center line c of the orifice 22 at a distance e. The spraying mechanism 28 is also located downstream from the tip of the die orifice 22 at a distance d. A lower spraying mechanism 30 is located below a center line c of the orifice 22 at a distance f and is located downstream from the tip of the die orifice 22 at a distance g. The upper and lower spraying mechanisms 28, 30 are positioned to emit a spray 32, 34 of a polar liquid onto the stream of free-fibers 24.

The spraying mechanisms 28, 30 may be used separately or simultaneously from multiple sides. The spraying mechanisms 28, 30 may be used to spray a vapor of polar liquid such as steam, an atomized spray or mist of fine polar liquid droplets, or an intermittent or continuous steady stream of a polar liquid. In general, the spraying step involves contacting the free fiber with the polar liquid by having the polar liquid supported by or directed through a gas phase in any of the forms just described. The spraying mechanisms 28, 30 may be located essentially anywhere between the die 20 and the collector 26. For example, in an alternate embodiment shown in FIG. 1, spraying mechanisms 28', 30' are located closer to the collector and even downstream to a source 36 that supplies staple fibers 37 to the web 25.

Spraying the free-fibers while they are in a molten state or in a semi-molten state has been found to maximize the imparted charge. The spraying mechanisms 28, 30 are preferably located as close to the stream of free-fibers 24 as possible (distances e and f are minimized), without interfering with the flow of free-fibers 24 to the collector 26. The distances e and f are preferably about 30.5 cm (one foot) or less, more preferably less than 15 cm (6 inches), laterally from the free fiber. The polar liquid may be sprayed perpendicular to the stream of free-fibers or at an acute angle, such as at an acute angle in the general direction of free-fiber movement.

As indicated, the spraying mechanisms 28, 30 are preferably located as close to the tip of the die 20 as possible (distances d and g are minimized). Physical constraints typically prevent locating the spraying mechanisms 28, 30 closer than about 2.5 cm (1.0 inch) to the tip of the die 20, although it may be possible to locate the spraying mechanisms 28, 30 closer to the die 20 if desired, for example, by using specialized equipment. The maximum distance the spraying mechanisms 28, 30 can be located from the tip of the die 20 (distances d and g) is dependent upon the process parameters, since spraying should occur before the fibers become entangled. Typically, distances d and g are less than 20 cm (6 inches).

The polar liquid is sprayed on the fibers in quantities sufficient to constitute an "effective amount." That is, the polar liquid is contacted with the free-fibers in an amount sufficient to enable an electret to be produced using the process of the invention. Typically, the quantity of polar liquid used is so great that the web is wet when initially formed on the collector. It may be possible, however, for no water to be present on the collector if, for example, the distance between the origin of the free-fiber and the collector is so great that the polar liquid dries while on the free-fiber rather than while on the collected web. In a preferred embodiment of the invention, however, the distance between the origin and collector are not so great, and the polar liquid is employed in such amounts that the collected web is wet with the polar liquid. More preferably, the web is so wet that the web will drip when slight pressure is applied. Still more preferably, the web is substantially or completely saturated with the polar liquid at the point where the web is formed on the collector. The web may be so saturated that the polar liquid regularly drips from the web without any pressure being applied.

The amount of polar liquid that is sprayed on the web may vary depending on the fiber production rates. If fiber is being produced at a relatively slow rate, lower pressures may be used because there is more time for the fiber to adequately contact the polar liquid. Thus, the polar liquid may be sprayed at a pressure of about 30 kilopascals (kPa) or greater. For faster fiber production rates, the polar liquid generally needs to be sprayed at greater throughputs. For example, in a melt-blowing process, the polar liquid preferably is applied at a pressure of 400 kilopascals or greater, more preferably at 500 to 800 kilopascals or greater. Higher pressures can generally impart better charge to the web, but too high a pressure may interfere with fiber formation. Thus, the pressure is typically kept below 3,500 kPa, more typically below 1,000 kPa.

Water is a preferred polar liquid because it is inexpensive. Also, no dangerous or harmful vapors are generated when it contacts the molten or semi-molten fiber-forming material. Preferably purified water, made through, for example, distillation, reverse osmosis, or deionization, is used in the present invention rather than simply tap water. Purified water is preferred because non-pure water can hinder effective fiber charging. Water has a dipole moment of about 1.85 Debye and has a dielectric constant of about 78–80.

Aqueous or nonaqueous polar liquids may be used in place of; or in conjunction with water. An "aqueous liquid" is a liquid that contains at least 50 volume percent water. A "nonaqueous liquid" is a liquid that contains less than 50 volume percent water. Examples of nonaqueous polar liquids that may be suitable for use in charging fibers include methanol, ethylene glycol, dimethyl sulfoxide, dimethylformamide, acetonitrile, and acetone, among others, or combinations of these liquids. The aqueous and nonaqueous polar liquids require a dipole moment of at least 0.5 Debye, and preferably at least 0.75 Debye, and more preferably at least 1.0 Debye. The dielectric constant is at least 10, preferably at least 20, and more preferably at least 50. The polar liquid should not leave a conductive, nonvolatile residue that would mask or dissipate the charge on the resulting web. In general, it has been found that there tends to be a correlation between the dielectric constant of the polar liquid and the filtration performance of the electret web. Polar liquids that have a higher dielectric constant tend to show greater filtration-performance enhancement.

For filtration applications, the nonwoven web preferably has a basis weight less than about 500 grams/meter$^2$ (g/m$^2$), more preferably about 5 to about 400 m$^2$, and still more preferably about 20 to 100 g/m$^2$. In making melt-blown fiber webs, the basis weight can be controlled, for example, by changing either die throughput or collector speed. The thickness of the nonwoven web for many filtration applications is about 0.25 to about 20 millimeters (mm), more typically about 0.5 to about 4 mm. The solidity of the resulting nonwoven web preferably is at least 0.03, more preferably about 0.04 to 0.15, and still more preferably about 0.05 to 0.1. Solidity is a unitless parameter that defines the solids fraction in the web. The inventive method can impart a generally uniform charge distribution throughout the resulting nonwoven web, without regard to basis weight, thickness, or solidity of the resulting media.

The collector 26 is located opposite the die 20 and typically collects wet fibers 24. The fibers 24 become entangled either on the collector 26 or immediately before impacting the collector. As indicated above, the fibers when collected are preferably damp, and more preferably are substantially wetted, and still more preferably are filled essentially to capacity or are substantially saturated with the polar liquid. The collector 26 preferably includes a web transport mechanism that moves the collected web toward a drying mechanism 38 as the fibers 24 are collected. In a preferred process, the collector moves continuously about an endless path so that electret webs can be manufactured continuously. The collector may be in the form of, for example, a drum, belt, or screen. Essentially any apparatus or operation suitable for collecting the fiber is contemplated for use in connection with the present invention. An example of a collector that may be suitable is described in U.S. patent application Ser. No. 09/181,205 entitled Uniform Meltblown Fibrous Web And Method And Apparatus For Manufacturing.

The drying mechanism 38 is shown located downstream from where the fibers 24 are collected—although it may be possible to dry the fibers before being collected (or both before and after being collected) to produce an electret web in accordance with the present invention. The drying mechanism may be an active drying mechanism, such as a heat source, a flow-through oven, a vacuum source, an air source such as a convective air source, a roller to squeeze the polar liquid from the web 25, or a combination of such devices. Alternatively, a passive drying mechanism—air drying at ambient temperatures—may be used to dry the web 25. Ambient air drying, however, may not be generally practical for high speed manufacturing operations. Essentially any device or operation suitable for drying the fibers and/or web is contemplated for use in this invention; unless the devices or operations were to somehow adversely impact the production of an electret. After drying, the resulting charged electret web 39 can then be cut into sheets, rolled for storage, or formed into various articles, such as filters for respirators.

The resulting charged electret web 39 may also be subjected to further charging techniques that might further enhance the electret charge on the web or might perform some other alteration to the electret charge that could possibly improve filtration performance. For example, the nonwoven fibrous electret web could be exposed to a corona charging operation after producing the electret product using the process described above. The web could be charged, for example, as described in U.S. Pat. No. 4,588,537 to Klaase et al., or as described in U.S. Pat. No. 4,592,815 to Nakao. Alternatively—or in conjunction with the noted charging techniques—the web could also be further hydrocharged as described in U.S. Pat. No. 5,496,507 to Angadjivand et al.

The charge of the fibrous electret web may also be supplemented using other charging techniques, such disclosed in the commonly assigned U.S. Patent applications entitled Method and Apparatus for Making a Fibrous Electret Web Using a Wetting Liquid and an Aqueous Polar Liquid Ser. No. 09/415,291; and Method of Making a Fibrous Electret Web Using a Nonaqueous Polar Liquid Ser. No. 09/416,216; all filed on the same day as the present case.

As shown in FIG. 1, staple fibers 37 may be combined with the free-fibers 24 to provide a more lofty, less dense web. "Staple fibers" are fibers that are cut or otherwise made to a defined length, typically of about 2.54 cm (1 inch) to about 12.7 cm (5 inches).

The staple fibers typically have a denier of 1 to 100. Reducing the web density 25 may be beneficial to reduce pressure drop across the web 25, which may be desirable for some filtering applications, such as in personal respirators. Once entrapped within the stream of free-fibers 24, the staple fibers 37 are sufficiently supported in the web and may also be charged by a polar liquid spray, such as by spraying mechanisms 28', 30', along with the free-fibers 24.

Staple fibers 37 may be introduced to the web 25 through use of a lickerin roll 40 disposed above the fiber blowing apparatus as shown in FIG. 1 (see also U.S. Pat. No. 4,118,531 to Hauser). A web 41 of fibers, typically a loose, nonwoven web prepared, for example, using a garnet or RANDO-WEBBER apparatus (available from Rando Machine Corp. of Rochester, N.Y.), is propelled along table 42 under drive roll 43 where the leading edge engages against the lickerin roll 40. The lickerin roll 40 picks off fibers from the leading edge of web 41 to create the staple fibers 37. The staple fibers 37 are conveyed in an air stream through an inclined trough or duct 46 into the stream of blown fibers 24 where the staple and blown fibers become mixed. Other particulate matter may be introduced into the web 25 using a loading mechanism similar to duct 46. Typically, no more than about 90 weight percent staple fibers 37 are present, and more typically no more than about 70 weight percent.

Active particulate also may be included in the electret webs for various purposes, including sorbent purposes, catalytic purposes, and others. U.S. Pat. No. 5,696,199 to Senkus et al., for example, describes various active particulate that may be suitable. Active particulate that has sorptive properties—such as activated carbon or alumina—may be included in the web to remove organic vapors during filtration operations. The particulate may be present in general in amounts up to about 80 volume percent of the contents of the web. Particle-loaded nonwoven webs are described, for example, in U.S. Pat. No. 3,971,373 to Braun, U.S. Pat. No. 4,100,324 to Anderson, and U.S. Pat. No. 4,429,001 to Kolpin et al.

Polymers, which may be suitable for use in producing fibers that are useful in this invention, include thermoplastic organic nonconductive polymers. The polymers can be synthetically produced organic macromolecules that consist essentially of recurring long chain structural units made from a large number of monomers. The polymers used should be capable of retaining a high quantity of trapped charge and should be capable of being processed into fibers, such as through a melt-blowing apparatus or a spun-bonding apparatus. The term "organic" means the backbone of the polymer includes carbon atoms. The term "thermoplastic" refers to a polymeric material that softens when exposed to heat. Preferred polymers include polyolefins, such as polypropylene, poly-4-methyl-1-pentene, blends or copolymers containing one or more of these polymers, and combinations of these polymers. Other polymers may include polyethylene, other polyolefins, polyvinylchlorides, polystyrenes, polycarbonates, polyethylene terephthalate, other polyesters, and combinations of these polymers and other nonconductive polymers. The free-fibers may be made from these polymers in conjunction with other suitable additives. The free-fibers may be extruded or otherwise formed to have multiple polymer components. See U.S. Pat. No. 4,729,371 to Krueger and Dyrud and U.S. Pat. Nos. 4,795,668, and 4,547,420 to Krueger and Meyer. The different polymer components may be arranged concentrically or longitudinally along the length of the fiber in the form of, for example, bicomponent fibers. The fibers may be arranged to form a macroscopically homogeneous web, which is a web that is made from fibers that each have the same general composition.

The fibers uged in the invention do not need to contain ionomers, particularly metal ion neutralized copolymers of ethylene and acrylic or methacrylic acid or both to produce a fibrous product suitable for filtration applications. Nonwoven fibrous electret webs can be suitably produced from the polymers described above without containing 5 to 25 weight percent (meth)acrylic acid with acid groups partially neutralized with metal ions.

For filtering applications, the fibers preferably are microfibers that have an effective fiber diameter less than 20 micrometers, and more preferably about 1 to about 10 micrometers, as calculated according to the method set forth in Davies, C. N., The Separation of Airborne Dust and Particles, Institution of Mechanical Engineers, London, Proceedings 1B (1952), particularly equation number 12.

The performance of the electret web can be enhanced by including additives in the fiber-forming material before contacting it to a polar liquid. Preferably, an "oily-mist performance enhancing additive" is used in conjunction with the fibers or the fiber-forming materials. An "oily-mist performance enhancing additive" is a component which, when added to the fiber-forming material, or for example, is placed on the resulting fiber, is capable of enhancing the oily aerosol filtering ability of the nonwoven fibrous electret web.

Fluorochemicals can be added to the polymeric material to enhance electret performance. U.S. Pat. Nos. 5,411,576 and 5,472,481 to Jones et al. describe the use of a melt-processable fluorochemical additive that has a melt temperature of at least 25° C. and that has a molecular weight of about 500 to 2500. This fluorochemical additive may be employed to provide better oily mist resistance. One additive class that is known to enhance electrets that have been charged with water jets are compounds that have a perfluorinated moiety and a fluorine content of at least 18% by weight of the additive—see U.S. Pat. No. 5,908,598 to Rousseau et al. An additive of this type is a fluorochemical oxazolidinone described in U.S. Pat. No. 5,411,576 as "Additive A" of at least 0.1% by weight of the thermoplastic material.

Other possible additives are thermally stable organic triazine compounds or oligomers, which compounds or oligomers contain at least one nitrogen atom in addition to those in the triazine ring. Another additive known to enhance electrets charged by jets of water is Chimassorb™ 944 LF (poly[[6-(1,1,3,3,-tetramethylbutyl)amino]-s-triazine-2,4-diyl][[(2,2,6,6-tetramethyl-4-piperidyl)imino] hexamethylene [(2,2,6,6-tetramethyl-4-piperidyl)imino]]), available from Ciba-Geigy Corp. Chimassorb™ 944 and "Additive A" may be combined. Preferably the additive Chimassorb™ and/or the above additives are present in an amount of about 0.1% to about 5% by weight of the polymer; more preferably, the additive(s) is present in an amount from about 0.2% to about 2% by weight of the polymer; and still more preferably is present in an amount from about 0.2 to about 1 weight % of the polymer. Some other hindered amines are also known to increase the filtration-enhancing charge imparted to the web. If the additive is heat sensitive, it may be introduced into the die 20 from a smaller side extruder immediately upstream to the orifice 22 in order to minimize the time it is exposed to elevated temperatures.

Fibers that contain additives can be quenched after shaping a heated molten blend of the polymer and additive—followed by annealing and charging steps—to create an electret article. Enhanced filtration performance can be imparted to the article by making the electret in this manner—see U.S. patent application Ser. No. 08/941,864, which corresponds to International Publication WO 99/16533. Additives also may be placed on the web after its formation by, for example, using the surface fluorination technique described in U.S. patent application Ser. No. 09/109,497, filed Jul. 2, 1998 by Jones et al.

The polymeric fiber-forming material has a volume resistivity of $10^{14}$ ohm-cm or greater at room temperature. Preferably, the volume resistivity is about $10^{16}$ ohm-cm or greater. Resistivity of the polymeric fiber-forming material can be measured according to standardized test ASTM D 257-93. The fiber-forming material used to form the melt blown fibers also should be substantially free from components such as antistatic agents that could increase the electrical conductivity or otherwise interfere with the fiber's ability to accept and hold electrostatic charges.

Nonwoven webs of this invention may be used in filtering masks that are adapted to cover at least the nose and mouth of a wearer.

Figure 3:
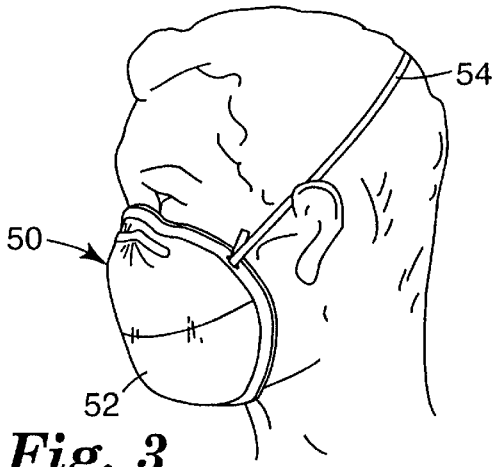
FIG. 3 is an example of a filtering face mask 50 that can utilize an electret filter medium produced in accordance with the present invention.

FIG. 3 illustrates a filtering face mask 50 that may be constructed to contain an electrically-charged nonwoven web produced according to the present invention. The generally cup-shaped body portion 52 is adapted to fit over the mouth and nose of the wearer. A strap or harness system 52 may be provided to support the mask on the wearer's face. Although a single strap 54 is illustrated in FIG. 3, the harness may come in a variety of configurations; see, for example, U.S. Pat. No. 4,827,924 to Japuntich et al., U.S. Pat. No. 5,237,986 to Seppalla et al., and U.S. Pat. No. 5,464,010 to Byram. Examples of other filtering face masks where nonwoven webs of the invention may be used include U.S. Pat. No. 4,536,440 to Berg; U.S. Pat. No. 4,807,619 to Dyrud et al.; U.S. Pat. No. 4,883,547 to Japuntich; 5,307,796 to Kronzer et al.; and U.S. Pat. No. 5,374,458 to Burgio. The present electret filter media also may be used in a filter cartridge for a respirator, such as in the filter cartridge disclosed in U.S. Pat. No. Re. 35,062 to Brostrom et al. or U.S. Pat. No. 5,062,421 to Burns and Reischel. Mask 50 thus is presented for illustration purposes only, and use of the present electret filter media is not limited to the embodiment disclosed.

Applicants believe that the present charging method deposits both positive and negative charge onto the fibers such that the positive and negative charge is randomly dispersed throughout the web. Random charge dispersal produces an unpolarized web. Thus, a nonwoven fibrous electret web produced in accordance with the present invention may be substantially unpolarized in a plane normal to the plane of the web. Fibers that have been charged in this manner ideally exhibit the charge configuration shown in FIG. 5C of U.S. patent application Ser. No. 08/865,362. If the fibrous web is also subjected to a corona charging operation, it would exhibit a charge configuration similar to the configuration shown in FIG. 5B of that patent application. A web, formed from fibers charged solely using the present method, typically has unpolarized trapped charge throughout the volume of the web. "Unpolarized trapped charge" refers to a fibrous electret web that exhibits less than 1 $\mu C/m^2$ of detectable discharge current using TSDC analysis, where the denominator is the electrode surface area. This charge configuration can be shown by subjecting the web to thermally-simulated discharge current (TSDC).

Thermally-stimulated discharge analysis involves heating an electret web so that the frozen or trapped charge regains mobility and moves to some lower energy configuration to generate a detectable external discharge current. For a discussion on thermally-stimulated discharge current, see Lavergne et al., A review of Thermo-Stimulated Current, IEEE ELECTRICAL INSULATION MAGAZINE, vol. 9, no. 2, 5–21, 1993, and Chen et al., *Analysis of Thermally Stimulated Process,* Pergamon Press, 1981.

An electric charge polarization can be induced in a web that has been charged according to the present invention by elevating the temperature to some level above the glass transition temperature ($T_g$) of the polymer, which is the temperature where a polymer changes to a viscous or rubbery condition from a hard and relatively-brittle one. The glass-transition temperature, $T_g$, is below the polymer's melting point ($T_m$). After raising the polymer above its $T_g$, the sample is cooled in the presence of an electric field to freeze-in the polarization of the trapped charge. Thermally-stimulated discharge currents can then be measured by reheating the electret material at a constant heating rate and measuring the current generated in an external circuit. An instrument useful for performing the polarization and subsequent thermally-stimulated discharge is a Solomat TSC/RMA model 91000 with a pivot electrode, distributed by TherMold Partners, L. P., Thermal Analysis Instruments of Stamford, Conn.

The discharge current is plotted on the y axis (ordinate) against the temperature on the x axis (abscissa). The peak (current maximum) position and shape of the discharge current are characteristics of the mechanism by which the charges have been stored in the electret web. For electret webs that contain a charge, the peak maximum and shape are related to the configuration of the charge trapped in the electret material. The amount of charge produced in the outside circuit due to movement of the charge inside the electret web to a lower energy state upon heating can be determined by integrating the discharge peak(s).

Advantages and other properties and details of this invention are further illustrated in the following Examples. It is to be expressly understood, however, that while the examples serve this purpose, the particular ingredients and amounts used and other conditions are not to be construed in a manner that would unduly limit the scope of this invention. The Examples selected for disclosure are merely illustrative of how to make a preferred embodiment of the invention and how the articles can generally perform.

EXAMPLES

Sample Preparation

Fibers were prepared generally as described by Van A. Wente, 48 INDUS. AND ENGN. CHEM., 1342–46 (1956), modified to include one or two atomizing spray bars mounted downstream from the die tip to spray a polar liquid on the fibers after extrusion and before collection. The resin was FINA 3860X thermoplastic polypropylene (available from Fina Oil and Chemical Co.) unless otherwise specified. The extruder was a Berstorff 60 millimeter, 44 to 1, eight barrel zone, co-rotating twin screw extruder available from Berstorff Corp. of Charlotte, N.C. When an additive was incorporated in the resin, it was prepared as a 10–15 weight percent concentrate in a Werner Pfleiderer 30 mm, 36 to 1 co-rotating twin screw extruder available from Werner & Pfeiderer Corp. of Ramsey, N.J. The polar liquid was water purified by reverse osmosis and deionization. The basis weight of the resulting web was about 54–60 grams/meter$^2$, unless otherwise specified.

DOP Penetration and Pressure Drop Test

The following summary of DOP penetration and pressure drop applies to Examples 1–30 and to the Initial Quality Factor references in the definitions set forth above and in the claims. The DOP Penetration and Pressure Drop Test was performed by forcing dioctyl phthalate (DOP) 0.3 micrometer mass median diameter particles through a sample of the nonwoven web that was 11.45 cm (4.5 inches) in diameter at a rate of 32 liters/minute (L/min). The face velocity on the sample was 5.2 centimeters per second. The DOP particles were at a concentration of between about 70 and about 110 milligrams/meter$^3$. The samples were exposed to the aerosol of DOP particles for 30 seconds. DOP particle penetration through the samples was measured using a model TSI 8110 Automated Filter Tester available from TSI of St. Paul, Minn. The pressure drop ($\Delta P$) across the sample was measured using an electronic manometer and was reported in millimeters of water.

The DOP penetration and pressure drop values were used to calculate quality factor, QF, from the natural log (ln) of the DOP penetration using the following formula:

$$QF[1/\text{mm } H_2O] = -(\ln((DOP \text{ Pen } \%)/100))/\text{Pressure Drop}[\text{mm } H_2O].$$

The higher the QF value, the better the filtration performance.

All samples tested below were tested for an Initial Quality Factor, $QF_i$.

Alternate DOP Penetration and Pressure Drop Test

An alternate DOP pressure drop test was utilized for Example 31 only. This test applies only to this Example. The alternate procedure was performed generally according to the procedure outlined above, except that the dioctyl phthalate (DOP) 0.3 micrometer mass median diameter particles at a concentration of between 70 and 110 mg/m$^3$ were generated using a TSI No. 212 sprayer with four orifices and 207 kPa (30 psi) clean air. DOP particles were forced through the sample of nonwoven web at a rate of 42.5 L/min, with a resulting face velocity of 6.9 cm/sec. The penetration was measured using an optical scattering chamber, Percent Penetration Meter Model TPA-8F available from Air Techniques Inc. of Baltimore, Md. The quality factor is calculated as discussed above. At this higher face velocity, the quality factor values will be somewhat lower than at the lower face velocity.

Examples 1–2 and Comparative Example C1

The following examples show the beneficial effect of spraying water on the free-fibers to increase quality factor.

Samples of Examples 1–2 and Comparative Example C1 all contained Chimassorb™ 944 at a concentration of 0.5 weigt percent, to enhance the charging. The sample of Example 1 was made using a single-air atomizing spray bar that had 6 individual spray nozzles mounted about 17.8 cm (7 inches) below the die center line and about 5.08 cm (2 inches) downsteam of the die tip. The spray bar was a model 1/4J available from Spraying Systems of Wheaton, Ill. Each spray nozzle had a fluid cap (model no. 2850) and an air cap (model no. 73320) for atomizing the water, both available from Spraying Systems. The water pressure in the sprayer was about 344.7 kPa (50 psi), and the air pressure in the sprayer was about 344.7 kPa (50 psi). Water was sprayed on the fibers in an amount sufficient to substantially wet the collected web. The collector was positioned about 35.6 cm (14 inches) downstream from the end of the die. The water was removed from the collected web by drying it in a batch oven at about 54.5° C. (130° F.).

The sample of Example 2 was sprayed using two air-atomizing spray bars. The spray bar of Example 1 was used as the top spray bar. The top spray bar was mounted about 17.8 cm (7 inches) above the die center line, and the bottom spray bar was mounted about 17.8 cm (7 inches) below the die center line. The bottom spray bar was an atomizing sonic spray system with 15 model no. SDC 035H spray nozzles, available from Sonic Environmental Corp. of Pennsauken, N.J. Both spray bars were located about 5.08 cm (2 inches) downstream from the die tip. The water and air pressure on each bar were about 344.7 kPa (50 psi). The web was wetted substantially more than the web of Example 1. The water was removed by drying the collected web in a batch oven at about 54.5° C. (130° F.). Comparative Example C1 is the same as Example 1 or 2 but without water spray. The results are Oven in Table 1.

TABLE 1

Effect of Water Spray on Free-fibers

| Example | Spray Bars | Pressure Drop (mm water) | Penetration (%) | $QF_i$ (mm $H_2O)^{-1}$ |
|---|---|---|---|---|
| 1 | One | 1.2 | 15.64 | 1.55 |
| 2 | Two | 1.56 | 5.86 | 1.82 |
| C1 | None | 1.76 | 76.1 | 0.16 |

The data of Table 1 show that spraying the free-fibers with an effective amount of water after extrusion and before collection increases $QF_i$ significantly, which indicates an improved ability of the collected web to filter particles from an air stream. The results also show that two spray bars may be more effective than one.

Examples 3–4

The following examples show the beneficial effect on $QF_i$ using Chimassorb™ 944 as an additive to the polymer. The concentration of Chimassorb™ 944 is shown in Table 2 as a weight percentage of the polymer. The water spray was carried out as described for Example 1 except that the water pressure on the fluid cap was about 138 kPa (20 psi), and the air pressure on the air cap was about 414 kPa (60 psi). The reduction in water pressure reduced the total volume of water on the web to less than Example 1. Heat from the fibers caused a portion of the water to evaporate before collection so that the collected nonwoven web was only damp.

Water was removed from the samples of Examples 3–4 by oven drying. The oven contained two perforated drums. Heated air is drawn through the web. The residence time of the web in the oven wag about 1.2 minutes at an air temperature of about 71.1° C. (160° F.). Ovens of this type are available from Aztec Machinery Co. of Ivyland, Penn. The results are given in Table 2.

TABLE 2

Effect of Chimassorb ™ 944 Additive

| Example | Chimassorb Conc. (Wt %) | Pressure Drop (mm water) | Penetration (%) | $QF_i$ (mm $H_2O)^{-1}$ |
|---|---|---|---|---|
| 3 | 0.0 | 1.5 | 66.1 | 0.28 |
| 4 | 0.5 | 1.8 | 47.0 | 0.42 |

The data of Table 2 demonstrate an improvement in $QF_i$ realized by adding Chimmassorb™ 944 to the thermoplastic material. The use of a lower water pressure deposits less water on the fibers and may reduce product performance as measured by $QF_i$ discussed further in examples 5–9 below.

Examples 5–9

The following examples show the effect of water pressure on quality factor. The spraying was carried out as described in Example 1 with a spray bar having a fluid cap and an air cap to atomize the polar liquid. The air pressure on the air cap was about 414 kPa (60 psi). The fluid pressure on the fluid cap is shown in Table 3.

Chimassorb™ 944 was present at about 0,5 weight percent based on the weight of polymer. Water was removed by oven drying as discussed in Examples 3–4. Excess water was removed from the web of Examples 8–9 by vacuuming the water before oven drying. Vacuuming was performed by passing the web over a vacuum bar having a vacuum slot in fluid communication with a vacuum chamber. The vacuum slots were about 6.35 mm (0.25 inches) wide and about 114.3 cm (45 inches) long. In Example 8, a single vacuum slot was used. In Example 9, two vacuum slots were used. The pressure drop across the slot as the web moves past was about 7.5 kPa (30 inches of water). The results are given in Table 3.

TABLE 3

Effect of Water Pressure

| Example | Water Pressure | Pressure Drop (mm water) | Penetration (%) | $QF_i$ (mm $H_2O)^{-1}$ |
|---|---|---|---|---|
| 5 | 138 kPa (20 psi) | 1.8 | 47.0 | 0.42 |
| 6 | 414 kPa (60 psi) | 2.2 | 27.5 | 0.59 |
| 7 | 552 kPa (80 psi) | 1.7 | 19.6 | 0.96 |
| 8* | 552 kPa (80 psi) | 2.1 | 9.4 | 1.12 |
| 9* | 552 kPa (80 psi) | 2.0 | 9.18 | 1.19 |

*Samples were vacuumed before oven drying

The data in Table 3 show that increasing the water pressure results in an increased $QF_i$. Examples 8 and 9 show that removal of excess water before drying the web can increase $QF_i$.

Examples 10–17

The following examples show an improved quality factor over the Examples in Table 3 by removing the air caps from the spray nozzles. The air caps atomize the water. Removing the air caps allows a stream of large water droplets to directly impact the molten polymer or fibers as they exit the die. The spray bar was moved to about 2.54 cm (1 inch) downstream of the die. Chimassorb™ 944 was present at about 0.5 weight percent based on the weight of the polymer. Use of the vacuum source of Example 8 is indicated in Table 4. Water was removed by oven drying as discussed in Examples 3–4.

TABLE 4

Resonator Caps Removed

| Example | Water Pressure | Pressure Drop (mm water) | Penetration (%) | $QF_i$ (mm $H_2O)^{-1}$ | Vacuum |
|---|---|---|---|---|---|
| 10 | 276 kPa (40 psi) | 1.8 | 21.7 | 0.85 | Yes |
| 11 | 276 kPa (40 psi) | 1.9 | 17.9 | 0.91 | No |
| 12 | 414 kPa (60 psi) | 2.0 | 20.1 | 0.80 | No |
| 13 | 414 kPa (60 psi) | 1.9 | 18.4 | 0.89 | Yes |
| 14 | 552 kPa (80 psi) | 1.8 | 13.6 | 1.11 | No |
| 15 | 552 kPa (80 psi) | 1.9 | 12.8 | 1.08 | Yes |
| 16 | 689.4 kPa (100 psi) | 1.8 | 11.0 | 1.23 | No |
| 17 | 689.4 kPa (100 psi) | 2.0 | 9.5 | 1.18 | Yes |

The data of Table 4 show an increase in $QF_i$ when larger drops of water are allowed to impact on the fibers, compared with the results in Table 3 when the air caps are on. When the air caps are removed, however, any improvement in $QF_i$ due to vacuuming was reduced on all samples, except the samples of Examples 12 and 13.

Examples 18–22

The following examples show the effect of web basis weight on $QF_i$. The samples were sprayed with the spray bar configuration of Example 1. The water pressure on the fluid cap was about 414 kPa (60 psi), and the air pressure on the air cap was about 276 kPa (40 psi). Water was removed by oven drying as discussed in Examples 3–4. Chimassorb™ 944 was present at about 0.5 weight percent based on the weight of the polymer. Basis weight is given in grams per square meter. The results are given in Table 5.

TABLE 5

Effect of Basis Weight

| Example | Water add on (%) | Basis Wt. (grams/$m^2$) | Thickness (mm) | Pressure Drop (mm water) | Penetration (%) | $QF_i$ (mm $H_2O)^{-1}$ |
|---|---|---|---|---|---|---|
| 18 | 59% | 25 | 0.51 | 0.69 | 21.4 | 2.24 |
| 19 | 130% | 50 | 0.94 | 1.81 | 4.5 | 1.71 |
| 20 | 134% | 100 | 1.7 | 2.82 | 0.8 | 1.71 |
| 21 | 131% | 150 | 2.6 | 3.79 | 0.1 | 1.85 |
| 22 | 143% | 200 | 3.3 | 5.21 | 0.025 | 1.59 |

The data in Table 5 show that $QF_i$ for basis weights ranging from about 50 grams/meter$^2$to about 150 grams/meter2 appear to be similar. $QF_i$ seems to drop off at a basis weight of about 200 grams/meter$^2$ and increase at a basis weight of about 25 grams/meter$^2$. This apparent result might be due to the pressure drop at high and low basis weights.

Examples 23–25

The following examples show the effect of effective fiber diameter (EFD) on $QF_i$. The spray bar was configured as described in Examples 18–22. The water pressure was about 60 psi, and the air pressure was about 40 psi. Water was removed by oven drying as discussed in Examples 3–4. Chimassorb™ 944 was present at a level of about 0.5 weight percent. The EFD is given in micrometers. The results are given in Table 6.

TABLE 6

Effect of Effective Fiber Diameter (EFD)

| Example | FD (micrometers) | Pressure Drop (mm water) | Penetration (%) | $QF_i$ (mm $H_2O)^{-1}$ |
|---|---|---|---|---|
| 23 | 8 | 1.81 | 17 | 1.71 |
| 24 | 10 | 1.51 | 4.4 | 2.07 |
| 25 | 12 | 1.25 | 7.3 | 2.10 |

The data in Table 6 show that $QF_i$ increases with increased effective fiber diameter.

Examples 26–27

The following examples show the effect of spray bar location on quality factor. The samples of these examples had a basis weight of about 57 grams/meter$^2$. The samples were sprayed with the spray bar configuration of Example 1. The water pressure on the fluid cap was about 414 kPa (60 psi), and the air pressure on the air cap was about 276 kPa (40 psi). Water was removed by oven drying as discussed in Examples 3–4. The results are given in Table 7. The location refers to distances d and g of FIG. 2.

TABLE 7

Effect of Spray Bar Location

| Example | Location (cm) | Pressure Drop (mm water) | Penetration (%) | $QF_i$ (mm $H_2O)^{-1}$ |
|---|---|---|---|---|
| 26 | 15.24 | 1.54 | 11.2 | 1.42 |
| 27 | 5.08 | 1.59 | 8.5 | 1.55 |

The data of Table 7 show an increase in filter performance when the spray bars are located closer to die. The water on the collected web of Example 26 was about 59 weight percent of the web's weight. The water on the collected web of Example 27 was about 28 weight percent of the web's weight. The quantity of water on the web of Example 26 was greater than the quantity of water on the web of Example 27 due to the placement of the spraying bars.

Examples 28–29

The following examples show the effect of using different resins on quality factor. Both examples used the spray bar used in Examples 18–22, located about 7.62 cm (3 inches) downstream from the die tip. In example 28, the resin was poly 4-methyl-1-pentene, available from Mitsui Petrochemical Industries, Tokyo, Japan as TPX-MX002. The water pressure was about 241.3 kPa (35 psi), and the air pressure was about 276 kPa (40 psi). Chimassorb™ 944 was added by a secondary extruder into the sixth zone of the main extruder to give about 0.5 weight percent of the extruded fibers. In example 29, the resin was a thermoplastic polyester available from Hoechst Celanese as Product No. 2002 (Lot no. LJ30820501). The water pressure was about 414 kPa (60 psi), and the air pressure was about 206.8 kPa (30 psi). Chimassorb™ 944 was added to the main extruder at about 0.5 weight percent of the extruded fibers. Water was removed by oven drying as discussed in Examples 3–4. The results are given in Table 8.

TABLE 8

| Effect of Resin | | | | | | |
|---|---|---|---|---|---|---|
| Example | Resin | Resin Conductivity | Pressure Drop (mm water) | Penetration (%) | Basis Weight (grams/meter$^2$) | $QF_i$ (mm $H_2O)^{-1}$ |
| 28 | poly 4-methyl-1-pentene | $<10^{-16}$ | 1.60 | 10 | 173 | 1.44 |
| 29 | polyester | $10^{-14}$* | 1.64 | 48.9 | 107 | 0.44 |

*estimated

The data of Table 8 show that it is possible under the present invention to use fibers made of different nonconductive resins.

Example 30

This example shows that charging additives can be used in the invention. The additive used to enhance charging in this example is disclosed in Example 22 from U.S. Pat. No. 5,908,598. In particular, N,N'-di-(cyclohexyl)-hexamethylene-diamine was prepared as described in U.S. Pat. No. 3,519,603. Next, 2-(tert.-octylamino)-4,6-dichloro-1,3,5-triazine was prepared as described in U.S. Pat. No. 4,297,492. Finally, this diamine was reacted with the dichlorotriazine described in U.S. Pat. No. 4,492,791 (hereinafter "triazine compound"). The additive was added at a level of about 0.5 weight percent of the thermoplastic material. Other conditions were as substantially described in Example 1. Water was removed by oven drying as discussed in Examples 3–4. The results are given in Table 9.

TABLE 9

| Additive | | | | | |
|---|---|---|---|---|---|
| Example | Additive | Pressure Drop (mm water) | Penetration (%) | Basis Weight (grams/meter$^2$) | $QF_i$ (mm $H_2O)^{-1}$ |
| 30 | Triazine Compound | 1.65 | 37.1 | 62 | 0.60 |

The data of Table 9 show that other additives can be used when forming electret media of the present invention.

Example 31

An electric charge polarization was induced in the webs of Examples 3 and 30 by elevating the temperature to 100° C., poling the sample in the presence of a DC field of about $E_{max}$=2.5 KV/mm at 100° C. for poling periods of about 10, 15 and 20 minutes, and cooling the sample to −50° C. in the presence of the DC field. The polarization of the trapped charge was "frozen-in" the web. Thermally stimulated discharge current (TSDC) analysis involves reheating the electret web so that the frozen charge regains mobility and moves to some lower energy state, thereby generating a detectable external discharge current. Polarization and subsequent thermally stimulated discharge was performed using a Solomat TSC/RMA model 91000 with a pivot electrode, distributed by TherMold Partners, L. P., Thermal Analysis Instruments of Stanford, Conn.

After cooling, the webs were reheated from about −50° C. to about 160° C. at a heating rate of about 3° C./minute. The external current generated was measured as a function of temperature. The total amount of charge released was obtained by calculating the area under the discharging peaks.

TABLE 10

| Measured Charge Density after Polarization | | | |
|---|---|---|---|
| Example | $QF_i$ Value (mm $H_2O)^{-1}$ | Charge Density ($\mu$C/m$^2$) | Poling Time to Max. Charge Density |
| 3 | 0.28 | 1.87 | Approx. 13.5 min. |
| 30 | 0.60 | 3.50 | Approx. 15 min. |

The data of Table 10 show that webs charged according to the present invention have randomly deposited charge when an electric charge polarization is induced. The samples were previously examined without subjecting them to poling at an elevated temperature. No significant signal was detected when TSDC was performed on those samples. Because a TSDC was only noticeable after an electric charge polarization was induced, the samples are believed to possess an unpolarized trapped charge.

All patents and patent applications cited above, including those cited in the Background, are incorporated by reference in total into this document.

The present invention may be suitably practiced in the absence of any element or step not specifically described in this document.

Changes may be made to the embodiments described above without departing from the scope and spirit of the invention. The present invention therefore is not limited to the methods and structures described above but only to elements and steps recited in the claims and any equivalents to those elements and steps.

What is claimed is:

1. A method of making a nonwoven fibrous electret web, which method comprises the steps of:

(a) forming one or more free-fibers from a nonconductive polymeric fiber-forming material;

(b) spraying an elective amount of polar liquid onto the free-fibers;

(c) collecting the free-fibers to form a nonwoven fibrous web; and (d) drying the fibers or the nonwoven web to form a nonwoven fibrous electret web.

2. The method of claim 1, wherein the nonwoven fibrous web contains at least a portion of the polar liquid before being dried.

3. The method of claim 2, wherein the nonwoven fibrous web is essentially saturated with the polar liquid before being dried.

4. The method of claim 1, wherein the polar liquid contains water.

5. The method of claim 1, consisting essentially of steps (a)–(d).

6. The method of claim 1, composed of steps (a)–(d).

7. The method of claim 1, further comprising the step of corona charging the nonwoven fibrous electret web.

8. The method of claim 1, wherein the nonwoven fibrous electret web exhibits a persistent electret charge.

9. The method of claim 1, wherein the nonwoven fibrous electret web exhibits an Initial Quality Factor of at least 0.9 (mm $H_2O)^{-1}$.

10. The method of claim 1, wherein the nonwoven fibrous electret web exhibits an Initial Quality Factor of at least 1.0 (mm $H_2O)^{-1}$.

11. The method of claim 1, wherein the nonwoven fibrous electret web exhibits an Initial Quality Factor of at least 1.3 (mm $H_2O)^{-1}$ when tested according to the DOP Penetration and Pressure Drop Test.

12. The method of claim 1, wherein the fibers in the nonwoven fibrous electret contain (poly[[6-(1,1,3,3,-tetramethylbutyl)amino]-s-triazine-2,4-diyl][[(2,2,6,6-tetramethyl-4-piperidyl)imino] hexamethylene [(2,2,6,6-tetramethyl-4-piperidyl)imino]]).

13. The method of claim 1, wherein the nonconductive polymeric fiber-forming material is free of metal ion neutralized copolymers of ethylene with acrylic or methacrylic acid or both.

14. The method of claim 1, wherein the nonwoven web comprises microfibers.

15. The method of claim 14, wherein the free-fibers are formed by extruding the fiber-forming material into a high-velocity gaseous stream.

16. The method of claim 1, wherein the free-fibers are in a molten state during the step of spraying the polar liquid.

17. The method of claim 1, wherein the free-fibers are in a semi-molten state during the step of spraying the polar liquid.

18. The method of claim 1, wherein the free-fibers are sprayed with an atomized polar liquid.

19. The method of claim 1, wherein the free-fibers are sprayed with a continuous stream of the polar liquid.

20. The method of claim 1, wherein the free-fibers contain an oily-mist performance enhancing additive.

21. The method of claim 20, wherein the fibers in the nonwoven fibrous electret web are treated with a fluorochemical compound.

22. The method of claim 1, further comprising the step of introducing staple fibers in the free-fibers.

23. The method of claim 22, wherein both the free-fibers and the staple fibers are sprayed with the polar liquid.

24. The method of claim 1, wherein the polar liquid is sprayed at a pressure of 30 kPa or greater.

25. The method of claim 1, wherein the polar liquid is sprayed at a pressure of about 400 kPa or greater.

26. The method of claim 1, wherein the polar liquid contains a nonaqueous polar liquid.

27. The method of claim 1, wherein the free-fibers are continuous during the step of spraying the polar liquid.

28. The method of claim 1, wherein the polar liquid is sprayed generally perpendicular to a stream of free-fibers.

29. The method of claim 1, wherein the polar liquid is sprayed at an acute angle in the general direction of free-fiber movement.

30. The method of claim 1, wherein the polar liquid is simultaneously sprayed onto the free-fibers from multiple sides.

31. The method of claim 1, wherein the nonwoven web is passively air dried.

32. The method of claim 1, wherein the drying step includes drying the nonwoven web by exposing the web to heat.

33. The method of claim 1, wherein the drying step includes drying the nonwoven web by exposing the web to a static vacuum.

34. The method of claim 1, wherein the drying step includes drying the nonwoven web by exposing the web to a stream of a heated drying gas.

35. The method of claim 1, wherein the nonwoven web is dried by mechanically removing the polar liquid, followed by exposure to heat.

36. The method of claim 1, wherein the nonwoven web is dried by exposing the web to a static vacuum, followed by exposing the web to a stream of a heated gas.

37. The method of claim 1, wherein the polymeric fibers contain polypropylene, poly-4-methyl-1-pentene, or both.

38. The method of claim 1, wherein the polymeric fibers contain a polyolefin, polyvinylchloride, polystyrene, polycarbonate, polyester, or a blend thereof.

39. The method of claim 1, wherein the nonwoven fibrous electret web is capable of demonstrating a quality factor increase when tested according to the DOP Penetration and Pressure Drop Test of at least a factor of 2 over a web formed from free-fibers that have not been sprayed with a polar liquid.

40. The method of claim 1, wherein the nonwoven fibrous electret web is capable of demonstrating a quality factor increase, when tested according to the DOP Penetration and Pressure Drop Test, of at least a factor of 10 over a web formed from free-fibers that have not been sprayed with a polar liquid.

41. The method of claim 1, wherein the fibrous electret web is substantially unpolarized in a plane normal to a plane of the web.

42. The method of claim 1, wherein the fibrous electret web exhibits substantially no discharging current when subjected to thermally stimulated discharge.

43. The method of claim 1, wherein the nonwoven web exhibits a discharge current upon heating the nonwoven web to a temperature greater than $T_g$, but less than $T_m$, subjecting the nonwoven web to a polarizing electric field, cooling the nonwoven web in the polarizing electric field, and reheating the web.

44. The method of claim 1, wherein the polar liquid is an aqueous liquid.

45. The method of claim 1, wherein the polar liquid is a nonaqueous liquid.

46. The method of claim 45, wherein the nonaqueous liquid contains methanol, ethylene glycol, dimethyl sulfoxide, dimethylformamide, acetonitrile, acetone, or combinations thereof.

* * * * *

UNITED STATES PATENT AND TRADEMARK OFFICE

CERTIFICATE OF CORRECTION

PATENT NO. : 6,375,886 B1
DATED : April 23, 2002
INVENTOR(S) : Angadjivand, Seyed A.

It is certified that error appears in the above-identified patent and that said Letters Patent is hereby corrected as shown below:

Column 1,
Line 39, delete “Where” and insert in place thereof -- where --.

Column 6,
Line 14, delete “CBEM” and insert in place thereof -- CHEM --.
Line 56, delete “he” and insert in place thereof -- the --.

Column 11,
Line 28, delete “uged” and insert in place thereof -- used --.

Column 15,
Line 2, delete “weigt” and insert in place thereof -- weight --.
Line 34, delete “oven” and insert in place thereof -- given --.

Column 16,
Line 2, delete “wag” and insert in place thereof -- was --.

Signed and Sealed this

Twenty-fourth Day of September, 2002

*Attest:*

*Attesting Officer*

JAMES E. ROGAN
*Director of the United States Patent and Trademark Office*